US010053976B2

(12) United States Patent
Nguyen et al.

(10) Patent No.: US 10,053,976 B2
(45) Date of Patent: Aug. 21, 2018

(54) LOCALIZED WIRELESS COMMUNICATIONS IN A DOWNHOLE ENVIRONMENT

(71) Applicant: Halliburton Energy Services, Inc., Houston, TX (US)

(72) Inventors: Tu Dinh Nguyen, Plano, TX (US); Kenneth L. Schwendemann, Flower Mound, TX (US)

(73) Assignee: Halliburton Engergy Services, Inc., Houston, TX (US)

( * ) Notice: Subject to any disclaimer, the term of this patent is extended or adjusted under 35 U.S.C. 154(b) by 0 days.

(21) Appl. No.: 15/540,193

(22) PCT Filed: Mar. 17, 2015

(86) PCT No.: PCT/US2015/020949
§ 371 (c)(1),
(2) Date: Jun. 27, 2017

(87) PCT Pub. No.: WO2016/148697
PCT Pub. Date: Sep. 22, 2016

(65) Prior Publication Data
US 2018/0003039 A1 Jan. 4, 2018

(51) Int. Cl.
*E21B 47/12* (2012.01)
*E21B 47/01* (2012.01)

(52) U.S. Cl.
CPC ..... *E21B 47/122* (2013.01); *E21B 47/01* (2013.01)

(58) Field of Classification Search
CPC ..... E21B 47/122; E21B 47/01
See application file for complete search history.

(56) References Cited

U.S. PATENT DOCUMENTS

| | | | |
|---|---|---|---|
| 7,261,162 | B2 | 8/2007 | Deans et al. |
| 8,237,585 | B2 | 8/2012 | Zimmerman et al. |
| 8,316,936 | B2 | 11/2012 | Covington et al. |
| 8,358,220 | B2 | 1/2013 | Savage et al. |
| 2002/0000808 | A1 | 1/2002 | Nichols et al. |
| 2003/0184303 | A1 | 10/2003 | Homan et al. |
| 2004/0263350 | A1 | 12/2004 | Vinegar et al. |

(Continued)

FOREIGN PATENT DOCUMENTS

| | | |
|---|---|---|
| WO | 2001055554 | 8/2001 |
| WO | 2009151444 | 12/2009 |

(Continued)

OTHER PUBLICATIONS

International Patent Application No. PCT/US2015/020949, "International Search Report and Written Opinion", dated Dec. 7, 2015, 15 pages.

*Primary Examiner* — Leon Flores
(74) *Attorney, Agent, or Firm* — Kilpatrick Townsend & Stockton LLP

(57) ABSTRACT

A system for use in a wellbore can include a first transceiver that is operable to transmit a wireless signal. The first transceiver can be positioned in an electrically isolated chamber between a tubular and a casing string for confining a transmission of the wireless signal to within the electrically isolated chamber. The system can also include a second transceiver that is positionable in the electrically isolated chamber for receiving the wireless signal from the first transceiver.

20 Claims, 6 Drawing Sheets

(56) References Cited

U.S. PATENT DOCUMENTS

| | | | | |
|---|---|---|---|---|
| 2008/0030365 | A1 | 2/2008 | Fripp et al. | |
| 2011/0168446 | A1* | 7/2011 | Lemenager | E21B 47/12 175/50 |
| 2013/0192825 | A1 | 8/2013 | Parsche et al. | |
| 2017/0342826 | A1* | 11/2017 | Wilson | E21B 47/122 |

FOREIGN PATENT DOCUMENTS

| | | |
|---|---|---|
| WO | 2012131601 | 10/2012 |
| WO | 2013112273 | 8/2013 |
| WO | 2016144340 | 9/2016 |

* cited by examiner

LOCALIZED WIRELESS COMMUNICATIONS IN A DOWNHOLE ENVIRONMENT

CROSS-REFERENCE TO RELATED APPLICATIONS

This is a U.S. national phase under 35 U.S.C. 371 of International Patent Application No. PCT/US2015/020949 titled "Localized Wireless Communications In A Downhole Environment" and filed Mar. 17, 2015, the entirety of which is incorporated herein by reference.

TECHNICAL FIELD

The present disclosure relates generally to devices for use in well systems. More specifically, but not by way of limitation, this disclosure relates to localized wireless communications in a downhole environment.

BACKGROUND

A well system (e.g., an oil or gas well for extracting fluid or gas from a subterranean formation) can include various sensors. For example, a well system can include sensors for measuring well system parameters, such as temperature, pressure, resistivity, or sound levels. The sensors can transmit data to a well operator (e.g., at the well surface) via cables. Cables can wear or fail, however, due to the harsh downhole environment or impacts with well tools. Further, a large number of sensors can require a large number of corresponding cables, which can be inefficient to install, expensive, and can take up a large amount of space in the well system.

DETAILED DESCRIPTION

Figure 1:
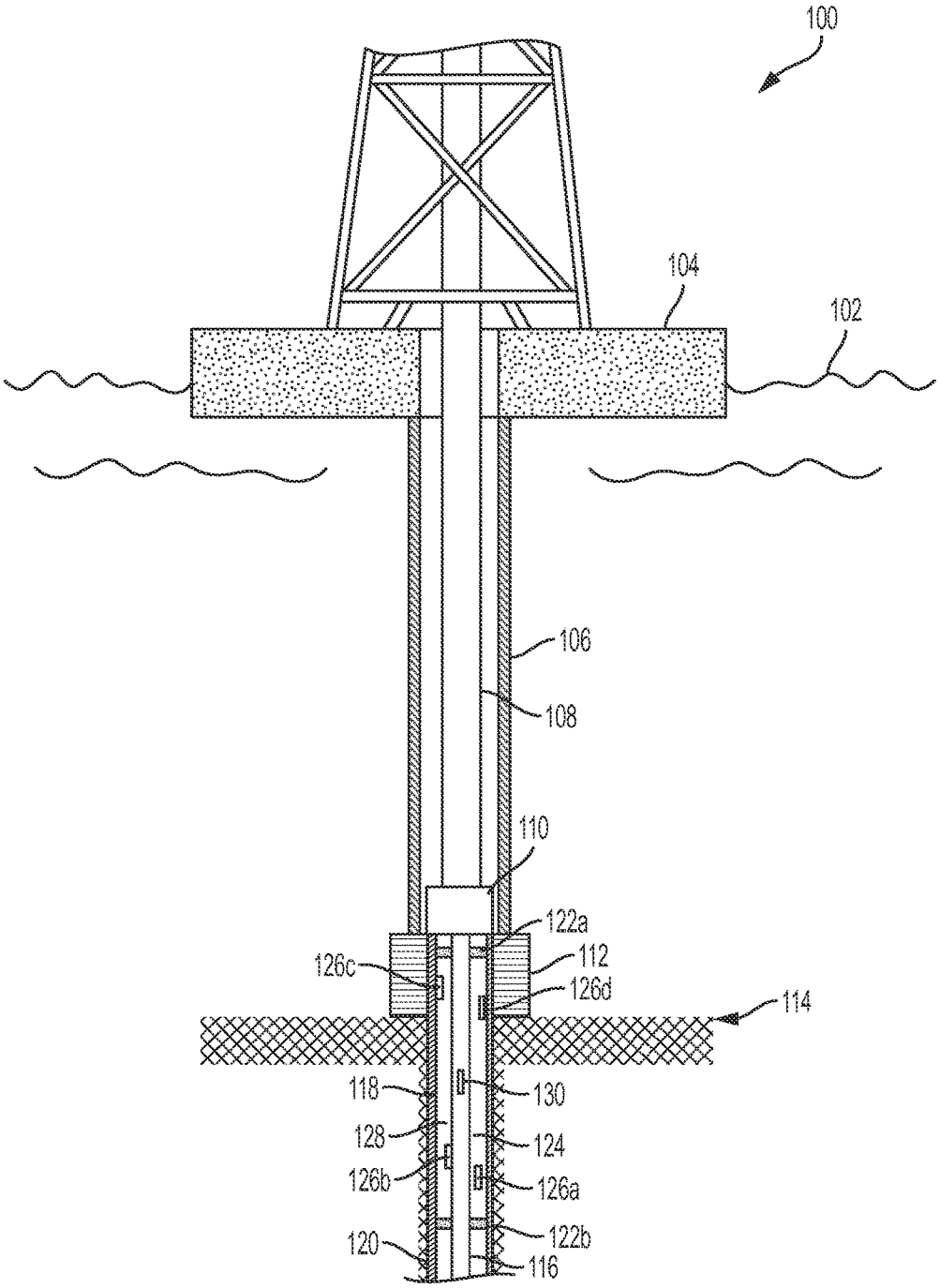
FIG. 1 is a cross-sectional view of an example of a well system that includes a system for localized wireless communications in a downhole environment according to some aspects.

Certain aspects and features of the present disclosure relate to communicating wirelessly and locally in a downhole environment. Multiple transceivers positioned in an electrically isolated chamber (e.g., a Faraday cage) in a wellbore can communicate wirelessly. The electrically isolated chamber can include a conductive housing (e.g., conductive walls) for preventing external wireless signals from entering the electrically isolated chamber and for preventing internal wireless signals from exiting the electrically isolated chamber. In some examples, the electrically isolated chamber can be cylindrically shaped and include a gap between a production string and a casing string in a wellbore. The production string can be positioned coaxially within an inner diameter of the casing string. The production string and the casing string can include conductive materials for forming the boundaries of the electrically isolated chamber. The transceivers can be positioned in the gap between the production string and the casing string. The production string and the casing string can confine wireless transmissions from the transceivers to within the gap.

In some examples, conductive materials can be positioned at either end of the electrically isolated chamber for further electrically isolating the transceivers. For example, if the transceivers are positioned in the gap between the production string and the casing string, one conductive material can be positioned farther uphole than the transceivers and another conductive material can be positioned farther downhole than the transceivers. The combination of the conductive materials, the production string, and the casing string can form a chamber that is electrically insulated and enclosed on all sides. This can localize wireless communications among the transceivers to within the electrically isolated chamber.

In some examples, positioning the transceivers within the electrically isolated chamber can reduce (or prevent) noise and wireless transmissions from outside the electrically isolated chamber from interfering with wireless communications among the transceivers. This can improve the power transmission efficiency of the wireless communications. In some examples, the electrically isolated chamber can also contain wireless transmissions from the transceivers to within the electrically isolated chamber. This may allow the transceivers to wirelessly communicate via frequency bands that may otherwise be unavailable (e.g., due to Federal Communications Commission regulations, because the frequency bands may otherwise be in use, or because the frequency bands may be kept unused for a particular reason, as with frequency guard bands). In some examples, communicating data among the transceivers wirelessly, rather than via a wired interface, can reduce the cost and complexity of the well system, and can make the transceivers easier to install in the well system.

In some examples, the transceivers can wirelessly communicate sensor data among each other. The transceivers can encode the sensor data in a wireless communication using frequency modulation, amplitude modulation, phase modulation, or any combination of these. In some examples, the transceivers can wirelessly communicate using a star topology, a mesh topology, or a hierarchical topology.

In some examples, the electrically isolated chamber can include an electrically insulative (e.g., non-conductive) substance, such as silicon oil or rubber. The electrically insulative substance can allow for the transceivers to be positioned in any configuration within the electrically isolated chamber, while minimally impacting wireless communications among the transceivers. For example, the transceivers can be floating or suspended within the electrically insulative substance between the casing string and the production tube. The transceivers can be randomly, sequentially, or otherwise positioned within the electrically isolated chamber. In some examples, the electrically insulative substance can provide stability to the electrically isolated chamber (e.g., to combat high downhole pressures).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100 for localized wireless communications in a downhole environment according to some aspects. The well system 100 includes a platform 104. In some examples, the platform 104 can be a floating rig or a vessel positioned at the sea surface 102. A riser 106 can extend from the platform 104 to a subsea tree 112. The subsea tree 112 can be positioned at the sea floor 114. The riser 106 can include a tubular 108 (e.g., a landing string). The tubular 108 can extend from the platform 104 to the subsea tree 112. In some examples, a well operator can use the tubular 108 to communicate fluid, power, well tools, and other well components between the sea surface 102 and the sea floor 114.

The subsea tree 112 can include ports, valves, and flow lines for controlling fluid flow through the well system 100. In some examples, the subsea tree 112 can control the flow of fluid through a tubular 116 (e.g., a production tube) positioned in a wellbore 120 (e.g., below the sea floor 114). The tubular 116 can be positioned in the wellbore 120 for extracting hydrocarbons from the wellbore 120. The tubular 116 can include a conductive material, such as copper, silver, aluminum, or any combination of these. In other examples, the subsea tree 112 can control the flow of fluid from the tubular 116 to other well tools in the well system 100. For example, the subsea tree 112 can control the flow of fluid from the tubular 116 to other well tools positioned on the sea floor 114. In some examples, the subsea tree 112 can include or otherwise be coupled to a subsea control system 110 for controlling the subsea tree 112.

The wellbore 120 can include a casing string 118. The casing string 118 can include a conductive material, such as copper, silver, aluminum, or any combination of these. The casing string 118 can be positioned in the wellbore 120 for preventing the walls of the wellbore 120 from collapsing.

In some examples, multiple transceivers 126*a-d* can be randomly, sequentially, or otherwise positioned in a space 124 between an outer housing of the tubular 116 and an inner housing of the casing string 118. The transceivers 126*a-d* can wirelessly communicate data (e.g., sensor data) among one another. In some examples, using wireless communication rather than wired communication can reduce the number of wires in the wellbore 120. This can reduce the cost and complexity of the well system 100.

In some examples, the transceivers 126*a-d* can be coupled to the tubular 116, to the casing string 118, or both. In other examples, an electrically insulative (e.g., non-conductive) substance can be positioned in the space 124 between the outer housing of the tubular 116 and an inner housing of the casing string 118. Examples of the electrically-insulative substance can include silicon oil or rubber. In some examples, a transceiver 126*a* can be positioned (e.g., floating or suspended) in the substance.

The conductivity of the tubular 116 and the casing string 118 can form an electrically isolated chamber 128. For example, the conductivity of the tubular 116 and the casing string 118 can form a cylindrically shaped Faraday cage around the transceivers 126*a-d*. This can prevent wireless communications from outside the wellbore from interfering with wireless transmissions (e.g., Bluetooth, 802.11, or any other electromagnetic wireless transmission protocol) from the transceivers 126*a-d*. In some examples, a conductive material 122*a-b* can be positioned in the wellbore 120 for further electrically isolating the transceivers 126*a-d*. In the example shown in FIG. 3, a conductive material 122*a* is positioned farther uphole than the transceivers 126*a-d* and another conductive material 122*b* is positioned farther downhole than the transceivers 126*a-d*. The combination of the conductive materials 122*a-b*, tubular 116, and the casing string 118 can form an electrically isolated chamber 128 that is electrically insulated on all sides. This can localize wireless communications among the transceivers 126*a-d* to within the electrically isolated chamber 128. In some examples, the electrical isolation can prevent the transceivers 126*a-d* from wirelessly communicating with a transceiver 130 positioned within the tubular 116 (e.g., in a well tool in the tubular 116) or elsewhere in the well system 100.

Figure 2:
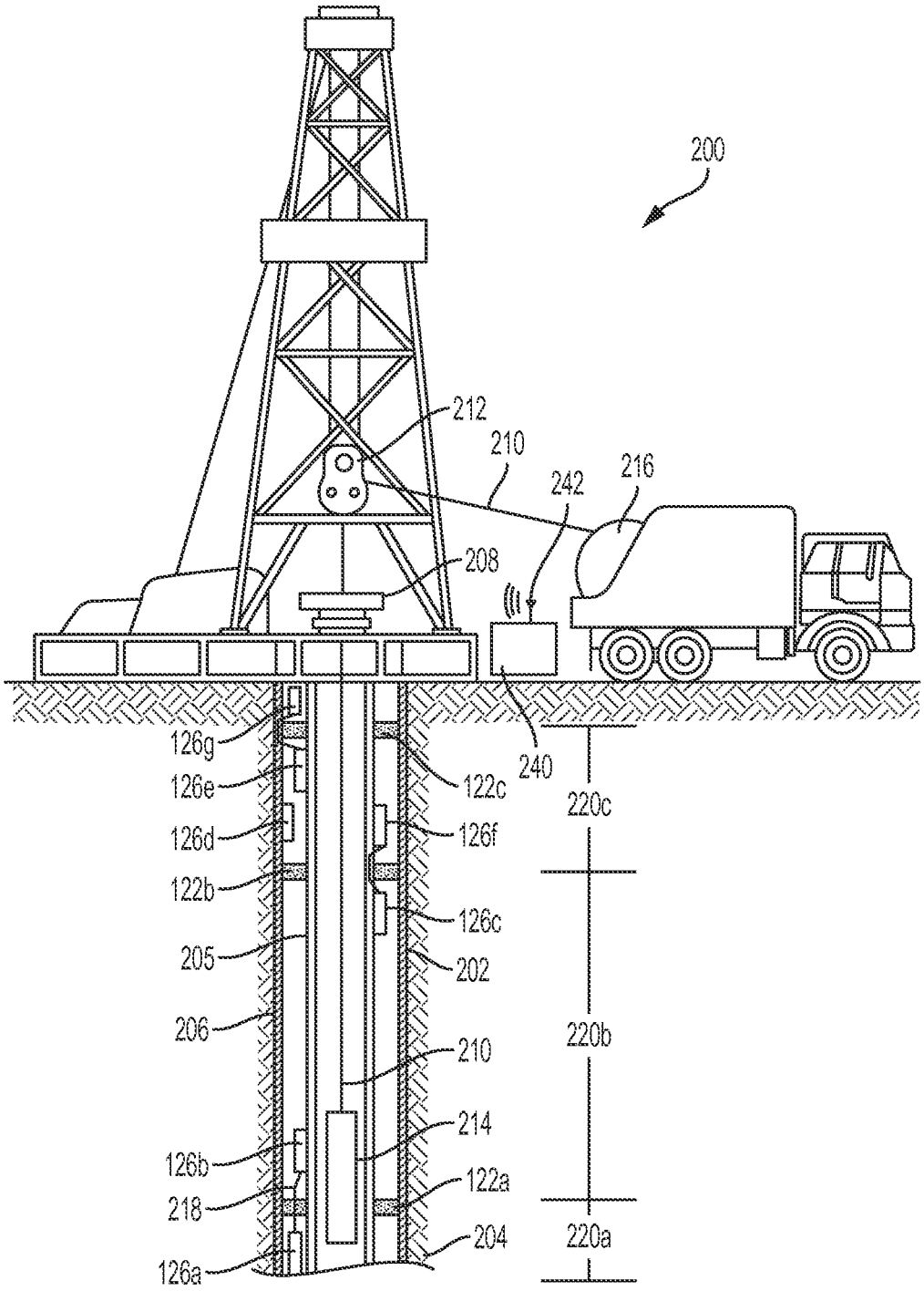
FIG. 2 is a cross-sectional view of another example of a well system that includes a system for localized wireless communications in a downhole environment according to some aspects.

FIG. 2 is a cross-sectional view of an example of another well system 200 for localized wireless communications in a downhole environment according to some aspects. The well system 200 includes a wellbore 202 extending through various earth strata. The wellbore 202 extends through a hydrocarbon bearing subterranean formation 204. A tubular 205 (e.g., a production tube) can extend from the surface 208 to the subterranean formation 204. The tubular 205 can provide a conduit through which formation fluids, such as production fluids produced from the subterranean formation, can travel form the wellbore 202 to the surface 208. In some examples, a casing string 206 can extend from the surface 208 to the subterranean formation 204. The casing string 206 can be coupled to the walls of the wellbore 202 via cement. For example, a cement sheath can be positioned or formed between the casing string 206 and the walls of the wellbore 202 for coupling the casing string 206 to the wellbore 202. In some examples, the casing string 206 can prevent the walls of the wellbore 202 from collapsing.

The well system 200 can also include at least one well tool 214 (e.g., a formation-testing tool). The well tool 214 can be coupled to a wireline 210, slickline, or coiled tube that can be deployed into the wellbore 202. The wireline 210, slickline, or coiled tube can be guided into the wellbore 202 using, for example, a guide 212 or winch. In some examples, the wireline 210, slickline, or coiled tube can be wound around a reel 216.

The tubular 205 and the casing string 206 can be conductive. The conductivity of the tubular 205 and the casing string 206 can form one or more electrically isolated chambers in which multiple transceivers 126*a-f* can be positioned. Positioning the transceivers 126*a-f* within electrically isolated chambers can reduce (or prevent) noise and wireless transmissions from outside the electrically isolated chambers from interfering with wireless communications among the transceivers 126*a-f*. The electrically isolated chambers can also contain wireless communications from the transceivers 126*a-f* within the chambers. In some examples, the electrical isolation can allow the transceivers 126*a-f* to wirelessly communicate via frequency bands that may otherwise be unavailable (e.g., due to Federal Communications Commission regulations, because the frequency bands may otherwise be in use, or because the frequency bands may be kept unused for a particular reason, as with frequency guard bands). In other examples, the electrical isolation can prevent the transceivers 126*a-f* from communicating with transceivers positioned within the tubular 205, such as transceivers coupled to the well tool 214.

In some examples, the well system 200 can include one or more conductive materials 122*a-c* for separating the wellbore 202 into multiple electrically isolated segments 220*a-c* or chambers. For example, the well system 200 can include the conductive material 122*a*, which can be positioned coaxially around the tubular 205. The conductive material 122*a* can electrically isolate one segment 220*a* from another segment 220*b* of the wellbore 202. This can prevent a transceiver 126*a* in one segment 220*a* from wirelessly communicating or interfering with another transceiver 126*b-c* in another segment 220*b*. Similarly, conductive material 122*b* can prevent transceivers 126*b-c* in segment 220*b* from wirelessly communicating or interfering with transceivers 126*d-f* in segment 220*c*. In this manner, the wellbore 202 can be divided into multiple electrically isolated segments 220*a-c*. This can reduce wireless interference among transceivers 126*a-f* in different segments 220*a-c*. For example, transceivers 126*b-c* can use the same frequency bands when wirelessly communicating as the transceivers 126*d-f*, without interfering with one another and allowing for the reuse of frequency bands.

In some examples, a transceiver 126*a* in one electrically isolated segment 220*a* can communicate with a transceiver 126*b* in another electrically isolated segment 220*b* via a wired interface. For example, a wire 218 can electrically couple the transceiver 126*a* to transceiver 126*b* for communicating between the transceivers 126*a-b*. The wire 218 can extend through the conductive material 122*a*, a portion of the casing string 206, a portion of the tubular 205, or any combination of these for electrically coupling the transceivers 126*a-b*. This can allow transceivers 126*a-b* in different electrically isolated segments 220*a-b* to communicate.

In some examples, the transceivers 126*a-g* can communicate data uphole or downhole via a combination of wired and wireless communications. For example, transceiver 126*a* can communicate data to transceiver 126*b* via a wired interface. Transceiver 126*b* can receive the data and wirelessly communicate the data to transceiver 126*c*. Transceiver 126*c* can receive the data and communicate the data via a wired interface (e.g., extending through the tubular 205) to transceiver 126*f*. Transceiver 126*f* can receive the data and wirelessly transmit the data to transceiver 126*e*. In some examples, the transceiver 126*e* can receive the data and communicate the data via a wired interface (e.g., extending through the casing string 206) to transceiver 126*g*. Transceiver 126*g* can receive the data and communicate the data via a wired or wireless interface to a computing device 240. In other examples, the transceiver 126*e* can directly transmit the data, via a wired interface (e.g., extending through the conductive materials 122*c*), to the computing device 240. In this manner, data can be communicated uphole (e.g., to a well operator) by the transceivers 126*a-g*, while maintaining the electrical isolation of each of the segments 220*a-c* or chambers.

The computing device 240 can be positioned at the surface 208, below ground, or offsite. The computing device 240 can include a processor interfaced with other hardware via a bus. A memory, which can include any suitable tangible (and non-transitory) computer-readable medium, such as RAM, ROM, EEPROM, or the like, can embody program components that configure operation of the computing device 240. In some aspects, the computing device 240 can include input/output interface components (e.g., a display, keyboard, touch-sensitive surface, and mouse) and additional storage.

The computing device 240 can include a communication device 242. The communication device 242 can represent one or more of any components that facilitate a network connection. In the example shown in FIG. 2, the communication device 242 is wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication device 242 can use acoustic waves, mud pulses, vibrations, optical waves, or induction (e.g., magnetic induction) for engaging in wireless communications. In other examples, the communication device 242 can be wired and can include interfaces such as Ethernet, USB, IEEE 1394, or a fiber optic interface.

Figure 3:
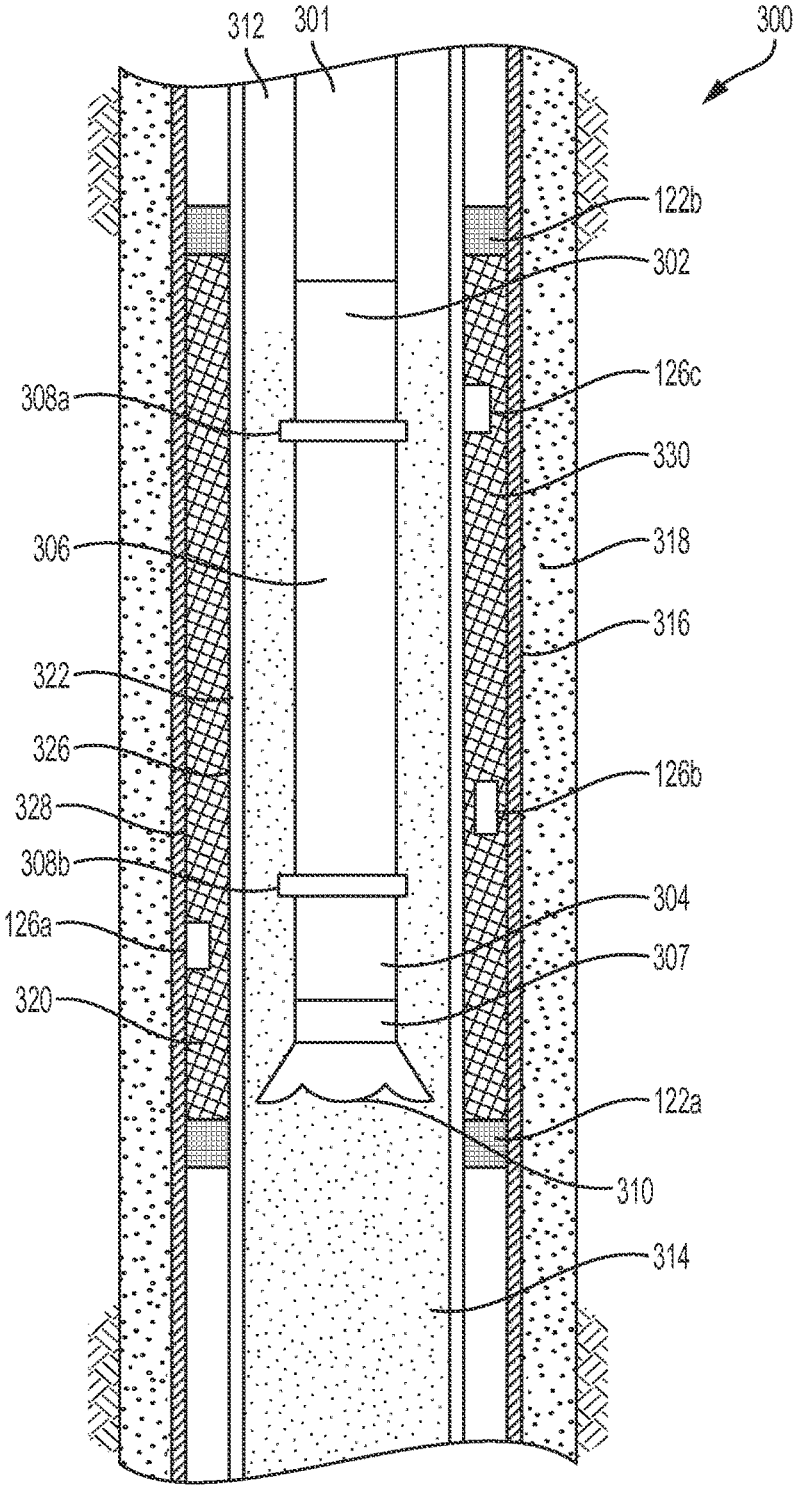
FIG. 3 is a cross-sectional side view of an example of a part of a well system that includes a system for localized wireless communications in a downhole environment according to some aspects.

FIG. 3 is a cross-sectional side view of an example of a part of a well system 300 for detecting a fluid flow direction downhole according to some aspects. In this example, the well system 300 includes a wellbore. The wellbore can include a casing string 316. A cement sheath 318 couples the casing string 316 to a wall of the wellbore. In some examples, the wellbore can include a fluid 314 (e.g., mud). The fluid 314 can flow in an annulus 312 of a tubular 326 (e.g., a production tube).

A well tool 301 (e.g., logging-while-drilling tool) can be positioned in the wellbore. The well tool 301 can include various subsystems 302, 304, 306, 307. For example, the well tool 301 can include a subsystem 302 that includes a communication subsystem. The well tool 301 can also include a subsystem 304 that includes a saver subsystem or a rotary steerable system. A tubular section or an intermediate subsystem 306 (e.g., a mud motor or measuring-while-drilling module) can be positioned between the other subsystems 302, 304. In some examples, the well tool 301 can include a drill bit 310 for drilling the wellbore. The drill bit 310 can be coupled to another tubular section or intermediate subsystem 307 (e.g., a measuring-while-drilling module or a rotary steerable system). In some examples, the well tool 301 can also include tubular joints 308*a*, 308*b*.

The tubular 326 and the casing string 316 can be conductive. The conductivity of the tubular 205 and the casing string 206 can form an electrically isolated chamber 320 between an outer housing 322 of the tubular 326 and an inner housing 328 of the casing string 316. In some examples, conductive materials 122*a-b* can be positioned within the chamber 320 for providing further electrically isolating the chamber 320.

Multiple transceivers 126*a-c* can be randomly, sequentially, or otherwise positioned in the chamber 320. The transceivers 126*c* can be coupled to the tubular 326, the casing string 316, or both. In some examples, an electrically insulative substance 330 can be positioned in the chamber 320. In one example, at least one transceiver 126*b* can be positioned in (e.g., floating in) the electrically insulative substance 330. In some examples, the electrically insulative substance 330 can provide stability to the chamber 320 (e.g., to combat high downhole pressures), allow for the transceivers 126*a-c* to be positioned in a particular configuration within the chamber 320, or both.

Figure 4:
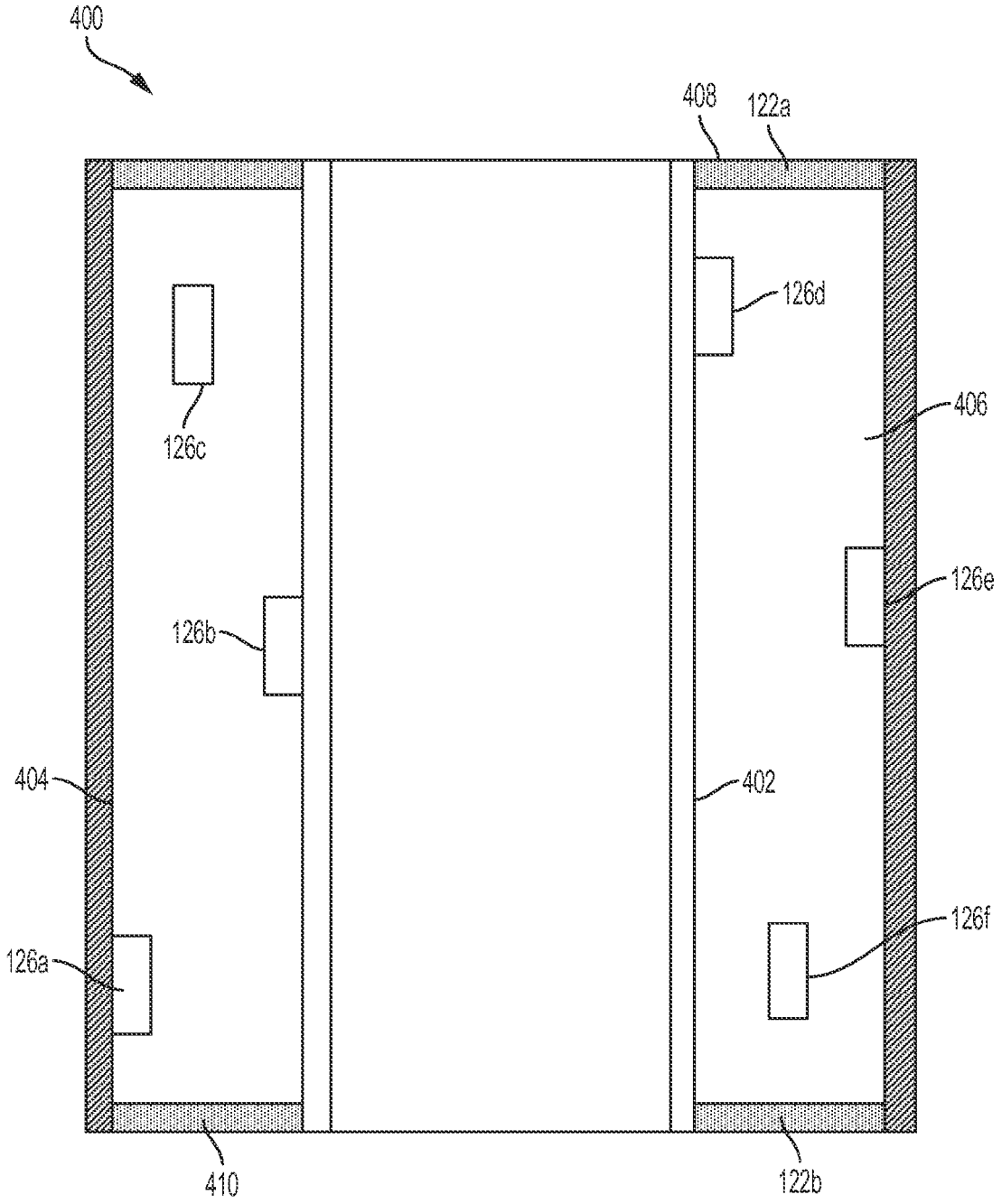
FIG. 4 is a cross-sectional side view of an example of a system for localized wireless communications in a downhole environment according to some aspects.

FIG. 4 is a cross-sectional side view of an example of a system 400 for localized wireless communications in a downhole environment according to some aspects. The system 400 includes an inner tubular 402 (e.g., a production tube) positioned within an outer tubular 404 (e.g., a casing string). A chamber 406 (e.g., space) is formed between the inner tubular 402 and the outer tubular 404. Because the inner tubular 402 and the outer tubular 404 can both include a conductive material, the chamber 406 can be electrically isolated from outside noise and wireless communications. In some examples, the system 400 includes conductive materials 122*a-b* for enclosing a top 408 and a bottom 410 of the chamber 406.

The chamber 406 can include multiple transceivers 126*a-f*. The transceivers 126*a-f* can be randomly, sequentially, or otherwise positioned in the system 400 (e.g., between the inner tubular 402 and the outer tubular 404). In some examples, the transceivers 126*a-f* can wirelessly communicate using a star topology, a mesh topology, or a hierarchical topology. For example, transceiver 126*a* can act as a central or master node for controlling wireless communications among the other transceivers 126*b-f*. Any number of transceivers 126*a-f* can act as master nodes for controlling wireless communications among the other transceivers 126*a-f*. In some examples, the transceivers 126*a-f* can encode data in a wireless communication using frequency modulation, amplitude modulation, phase modulation, or any combination of these. The transceivers 126*a-f* can wirelessly communicate using Bluetooth, 802.11, or any other electromagnetic wireless transmission protocol.

In some examples, the inner tubular 402 can block a direct communication path between transceivers 126*a-f* on either side of the inner tubular 402. For example, the inner tubular 402 can block a direct communication path between transceiver 126*a* and transceiver 126*f*. In some examples, wireless transmissions from one transceiver 126*a* can bounce or deflect off the inner wall of the inner tubular 402, the outer tubular 404, or both to effectuate wireless communication between the transceivers 126*a*, 126*f*. In some examples, the closer that any two of the transceivers 126*a-f* are positioned with respect to one another, the stronger the signal strength of wireless communications between the two transceivers 126*a-f* will be.

In some examples, each of the transceivers 126*a-f* can include one or more sensors. The sensor can detect a characteristic of a transceiver 126*a-f*, a characteristic of a well tool, a characteristic an environment in a wellbore, or any combination of these. Examples of the sensors can include a temperature sensor, pressure sensor, vibration sensor, acoustic sensor (e.g., a microphone), strain gauge, flow sensor, tilt sensor, accelerometer, gyroscope, inclinometer, or any combination of these. Each of the transceivers 126*a-f* can gather data (e.g., in real time) via a respective sensor and transmit the data to another transceiver 126*a-f*.

In some examples, the system 400 can be positioned in a well tool (e.g., in a particular module in the well tool). For example, the system 400 can be positioned in a well tool in a subsea wellbore (e.g., wellbore 120 of FIG. 1). As another example, the system 400 can be positioned in the well tool 214 of FIG. 2 or the well tool 301 of FIG. 3. In some examples, multiple systems 400 can be positioned in a well tool or the wellbore. Each of the multiple systems 400 can be electrically isolated from the other systems 400. In some examples, a transceiver 126*a* in the system 400 can be in wired communication with another transceiver in another system 400 for communicating between the systems 400.

Figure 5:
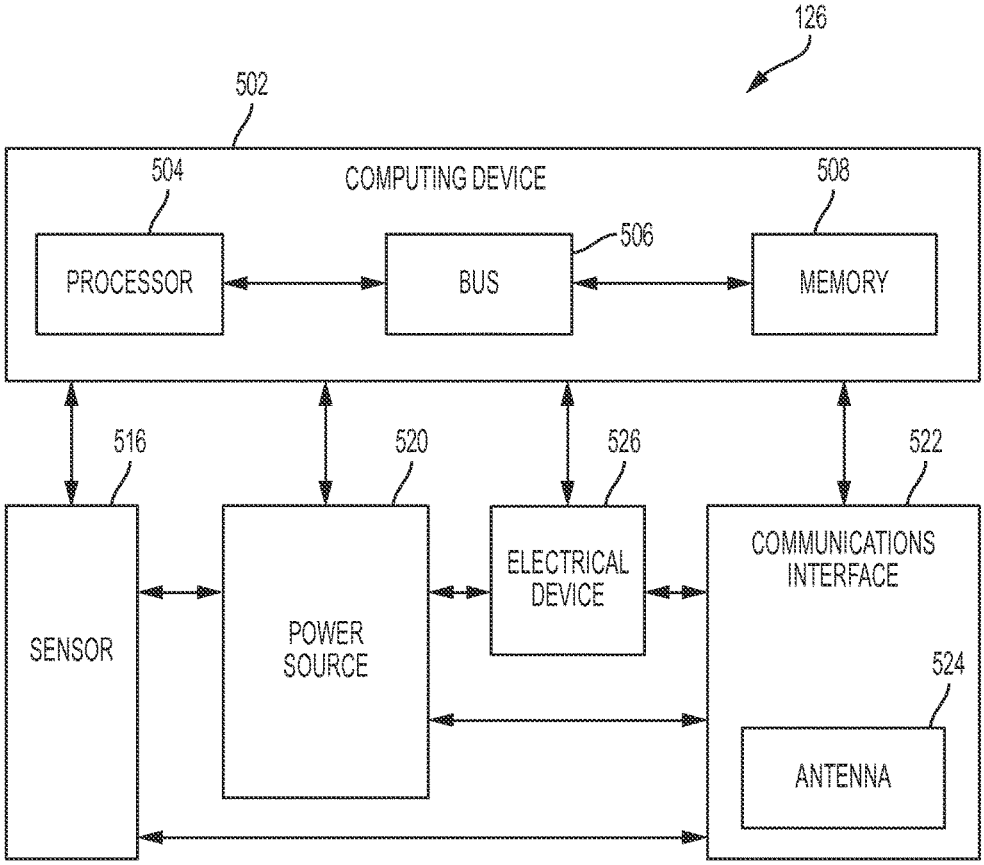
FIG. 5 is a block diagram of an example of a transceiver for implementing localized wireless communications in a downhole environment according to some aspects.

FIG. 5 is a block diagram of an example of a transceiver 126 for implementing localized wireless communications in a downhole environment according to some aspects. In some examples, the components shown in FIG. 5 (e.g., the computing device 502, power source 520, electrical device 526, sensor 516, and communications interface 522) can be integrated into a single structure. For example, the components can be within a single housing. In other examples, the components shown in FIG. 5 can be distributed (e.g., in separate housings) and in electrical communication with each other.

The transceiver 126 can include a computing device 502. The computing device 502 can include a processor 504, a memory 508, and a bus 506. The processor 504 can execute one or more operations for operating the transceiver 126. The processor 504 can execute instructions stored in the memory 508 to perform the operations. The processor 504 can include one processing device or multiple processing devices. Non-limiting examples of the processor 504 include a Field-Programmable Gate Array ("FPGA"), an application-specific integrated circuit ("ASIC"), a microprocessor, etc.

The processor 504 can be communicatively coupled to the memory 508 via the bus 506. The non-volatile memory 508 may include any type of memory device that retains stored information when powered off. Non-limiting examples of the memory 508 include electrically erasable and programmable read-only memory ("EEPROM"), flash memory, or any other type of non-volatile memory. In some examples, at least some of the memory 508 can include a medium from which the processor 504 can read instructions. A computer-readable medium can include electronic, optical, magnetic, or other storage devices capable of providing the processor 504 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The transceiver 126 can include a power source 520. The power source 520 can be in electrical communication with the computing device 502, the communications interface 522, the electrical device 526, the sensor 516, or any combination of these. In some examples, the power source 520 can include a battery or a thermal electric generator (e.g., for powering the transceiver 126). In other examples, the transceiver 126 can be coupled to and powered by an electrical cable (e.g., a wireline).

Additionally or alternatively, the power source 520 can include an AC signal generator. The computing device 502 can operate the power source 520 to apply a transmission signal to the antenna 524. For example, the computing device 502 can cause the power source 520 to apply a voltage with a frequency to the antenna 524 to generate a wireless communication. In other examples, the computing device 502, rather than the power source 520, can apply the transmission signal to the antenna 524 to generate the wireless communication.

The transceiver 126 can include a communications interface 522. The communications interface 522 can include or can be coupled to an antenna 524. In some examples, part of the communications interface 522 can be implemented in software. For example, the communications interface 522 can include instructions stored in memory 508.

The communications interface 522 can detect signals from another transceiver 126. In some examples, the communications interface 522 can amplify, filter, demodulate, demultiplex, demodulate, frequency shift, and otherwise manipulate the detected signals. In some examples, the communications interface 522 can receive a signal at a frequency from one transceiver 126, frequency shift the signal to another frequency, and transmit the frequency shifted signal to another transceiver 126. In this manner, the transceiver 126 can receive a signal in one frequency band and relay data to another transceiver 126 using another frequency band, without converting the data to a digital signal (e.g., for use by the processor 504). This may save time and power. In other examples, the communications interface 522 can transmit a signal associated with the detected signals to the processor 504. The processor 504 can receive and analyze the signal to retrieve data associated with the detected signals.

In some examples, the processor 504 can analyze the data from the communications interface 522 and perform one or more functions. For example, the processor 504 can generate a response based on the data. The processor 504 can cause a response signal associated with the response to be transmitted to the communications interface 522. The communications interface 522 can generate a transmission signal (e.g., via the antenna 524) to communicate the response to another transceiver 126. For example, the processor 504 or communications interface 522 can amplify, filter, modulate, frequency shift, multiplex, and otherwise manipulate the response signal to generate the transmission signal. In some examples, the communications interface 522 can encode data within the response signal using a modulation technique (e.g., frequency modulation, amplitude modulation, or phase modulation) to generate the transmission signal. The communications interface 522 can transmit the transmission signal to the antenna 524. The antenna 524 can receive the transmission signal and responsively generate a wireless communication. In this manner, the processor 504 can receive, analyze, and respond to communications from another transceiver 126.

The transceiver 126 can include a sensor 516. The sensor 516 can detect a characteristic of a transceiver 126, a characteristic of a well tool, a characteristic an environment in a wellbore, or any combination of these. Examples of the sensor 516 can include a pressure sensor, temperature sensor, microphone, accelerometer, gyroscope, inclinometer, depth sensor, resistivity sensor, strain gauge, electromagnetic sensor, vibration sensor, ultrasonic transducer, GPS unit, fluid analyzer or sensor, RFID tag, and a RFID reader. The sensor 516 can transmit data to the processor 504. The processor 504 can perform one or more functions based on the data, communicate the data (via the communications interface 522) to another transceiver 126, or both.

In some examples, the transceiver 126 can include or can be electrically coupled to one or more electrical devices 526 (e.g., an external electronic device 526). The electrical device 126 can include a valve (e.g., a electrohydraulic valve), a ferromagnetic material, motor, well tool, and/or any other electrical device 126. In some examples, the transceiver 126 can operate or otherwise control the electrical device 526. For example, the processor 504 can receive sensor signals from the sensor 516 and operate the electrical device 526 based on the sensor signals. In other examples, the electrical device 526 can transmit data to the processor 504, the communications interface 522, or both. For example, the electrical device 526 can transmit data to the processor 504, which can receive, analyze, and perform an operation based on the data.

In some examples, the transceiver 126 may not include the computing device 502. In such an example, the sensor 516 and communications interface 522 can directly communicate with one another. For example, the sensor 516 can directly communicate data to the communications interface 522 for wireless transmission. In some examples, the electrical device 526 can directly communicate with the communications interface 522. For example, the electrical device 526 can communicate data to the communications interface 522 for wireless transmission.

Figure 6:
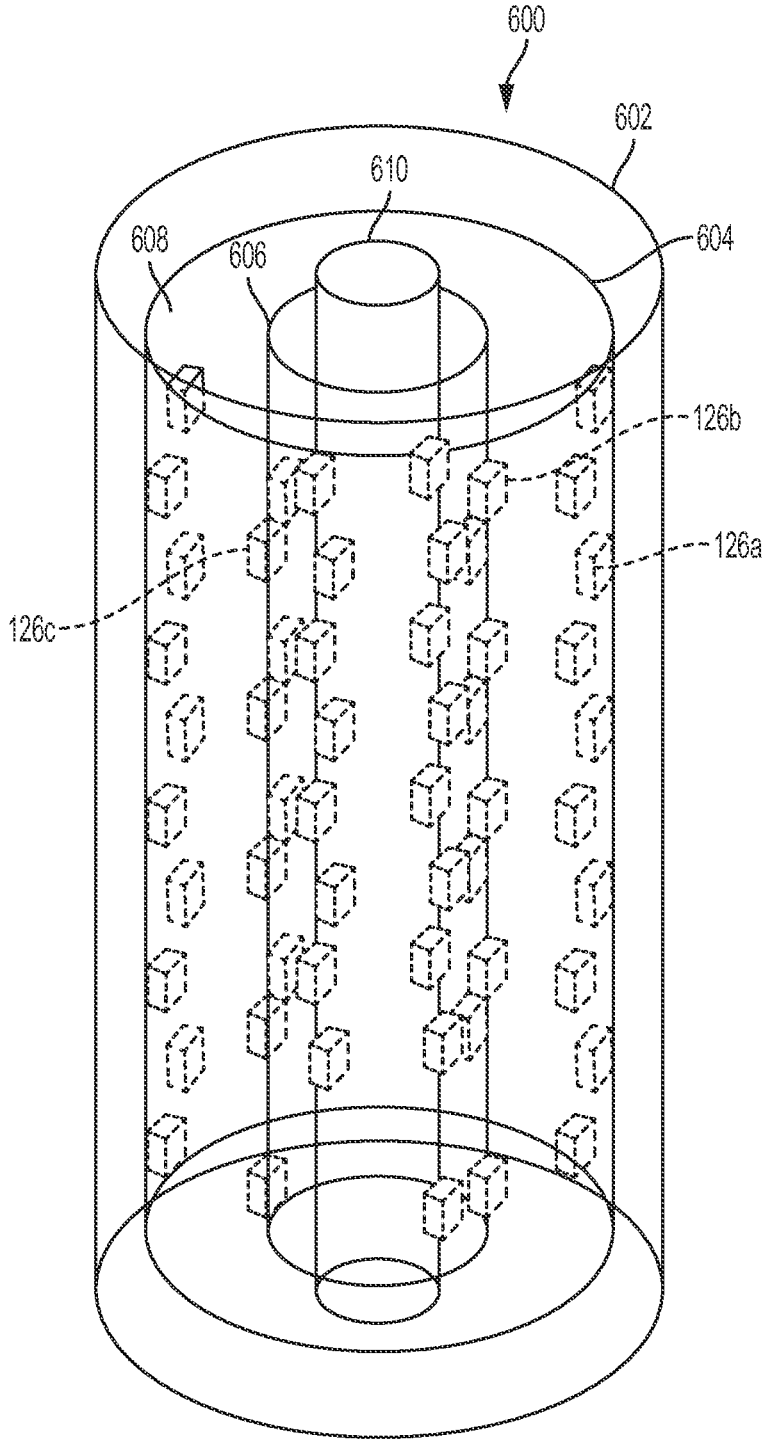
FIG. 6 is a perspective view of an example of a system for localized wireless communications in a downhole environment according to some aspects.

FIG. 6 is a perspective view of an example of a system 600 for localized wireless communications in a downhole environment according to some aspects. The system 600 can include an outer tubular 602 (e.g., a wellbore). A middle tubular 604 (e.g., a casing string) can be positioned coaxially within the outer tubular 602, the middle tubular 604 having a smaller diameter than the outer tubular 602. The middle tubular 604 can include any suitable conductive material for forming an electrically isolated chamber. An inner tubular 606 (e.g., a production string) can be positioned coaxially within the middle tubular 604, the inner tubular 606 having a smaller diameter than the middle tubular 604. This can form a gap 608 between the middle tubular 604 and the inner tubular 606. The inner tubular 606 can include any suitable conductive material for forming an electrically isolated chamber.

The gap 608 can be an electrically isolated chamber. The gap 608 (e.g., electrically isolated chamber) can include a substantially cylindrical shape. In some examples, multiple transceivers 126*a-c* can be positioned within the gap 608. For example, a transceiver 126*a* can be coupled to an inner housing (e.g., an interior) of the middle tubular 604. A transceiver 126*b* can be suspended (e.g., using a non-conductive substance) between the middle tubular 604 and the inner tubular 606. A transceiver 126*c* can be coupled to an outer housing (e.g., an exterior of) of the inner tubular 606. The conductivity of the inner tubular 606 and the conductivity of the middle tubular 604 can prevent internal wireless signals from exiting the gap 608, and external wireless signals from entering the gap 608.

In some examples, still another tubular 610 (e.g., a well tool) can be positioned coaxially within the inner tubular 606. In other examples, the system 600 may not include the tubular 610 or the outer tubular 602.

In some aspects, systems are methods for localized wireless communications in a downhole environment are provided according to one or more of the following examples:

Example #1

A system for use in a wellbore can include a first transceiver that is operable to transmit a wireless signal. The first transceiver can be positioned in an electrically isolated chamber between a tubular and a casing string for confining a transmission of the wireless signal to within the electrically isolated chamber. The system can also include a second transceiver that is positionable in the electrically isolated chamber for receiving the wireless signal from the first transceiver.

Example #2

The system of Example #1 may feature the tubular and the casing string both including a conductive material and defining outer boundaries of the electrically isolated chamber.

Example #3

The system of any of Examples #1-2 may feature the first transceiver being coupled to the tubular and the second transceiver being coupled to the casing string.

Example #4

The system of any of Examples #1-3 may feature a second electrically isolated chamber between the tubular and the casing string for confining wireless signals from a third transceiver positioned in the second electrically isolated chamber to within the second electrically isolated chamber. The second electrically isolated chamber can be separate from the electrically isolated chamber.

Example #5

The system of Example #4 may feature the third transceiver is operable to receive data from the second transceiver via a wire and wirelessly transmit the data to a fourth transceiver positioned in the second electrically isolated chamber. The wire can extend between the electrically isolated chamber and the second electrically isolated chamber.

Example #6

The system of any of Examples #1-5 may feature the first transceiver including a sensor operable to generate data that can be encoded in the wireless signal using frequency modulation.

Example #7

The system of any of Examples #1-6 may feature the electrically isolated chamber being operable to prevent external wireless communications from entering the electrically isolated chamber.

Example #8

A system can include an electrically isolated chamber that is between a tubular and a casing string in a wellbore for confining a transmission of a wireless signal to within the electrically isolated chamber. The system can also include a first transceiver that is positioned in the electrically isolated chamber for transmitting the wireless signal.

Example #9

The system of Example #8 may feature a second transceiver that is positionable in the electrically isolated chamber for receiving the wireless signal from the first transceiver. The first transceiver can be coupled to the tubular and the second transceiver can be coupled to the casing string.

Example #10

The system of any of Examples #8-9 may feature the tubular and the casing string both including a conductive material and defining outer boundaries of the electrically isolated chamber.

Example #11

The system of any of Examples #8-10 may feature a second electrically isolated chamber between the tubular and the casing string for confining wireless signals from a third transceiver positioned in the second electrically isolated chamber to within the second electrically isolated chamber. The second electrically isolated chamber can be separate from the electrically isolated chamber.

Example #12

The system of Example #11 may feature the third transceiver being operable to receive data from a second transceiver via a wire and wirelessly transmit the data to a fourth transceiver positioned in the second electrically isolated chamber. The wire can extend between the electrically isolated chamber and the second electrically isolated chamber.

Example #13

The system of any of Examples #8-12 may feature the first transceiver including a sensor operable to generate data that can be encoded in the wireless signal using frequency modulation.

Example #14

The system of any of Examples #8-13 may feature the electrically isolated chamber being operable to prevent external wireless communications from entering the electrically isolated chamber.

Example #15

A system for use in a wellbore can include a first transceiver that is positionable in a first electrically isolated chamber between a tubular and a casing string. The first electrically isolated chamber can be operable to confine a transmission of a wireless signal from the first transceiver to within the first electrically isolated chamber. The system can also include a second transceiver that is positionable in a second electrically isolated chamber between the tubular and the casing string. The second electrically isolated chamber can be operable to confine another transmission of another wireless signal from the second transceiver to within the second electrically isolated chamber. The second electrically isolated chamber can be separate from the first electrically isolated chamber.

Example #16

The system of Example #15 may feature the tubular and the casing string including conductive materials and defining outer boundaries of the first electrically isolated chamber and the second electrically isolated chamber.

Example #17

The system of any of Examples #15-16 may feature the first electrically isolated chamber or the second electrically isolated chamber including silicon oil or rubber for positioning the first transceiver or the second transceiver in a particular location within the first electrically isolated chamber or the second electrically isolated chamber, respectively.

Example #18

The system of any of Examples #15-17 may feature the first transceiver being coupled to the tubular and the second transceiver being coupled to the casing string.

Example #19

The system of any of Examples #15-18 may feature the first transceiver being operable to receive data via a wired interface from the second transceiver and wirelessly transmit the data to a third transceiver positioned in the first electrically isolated chamber.

Example #20

The system of any of Examples #15-19 may feature the second transceiver including a sensor operable to generate the data.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system for use in a wellbore, the system comprising:

a first transceiver that is operable to transmit a wireless signal and is positioned in an electrically isolated chamber between a tubular and a casing string, the electrically isolated chamber being configured to confine a transmission of the wireless signal to within the electrically isolated chamber; and a second transceiver that is positionable in the electrically isolated chamber for receiving the wireless signal from the first transceiver.

2. The system of claim 1, wherein the tubular and the casing string both comprise a conductive material and define outer boundaries of the electrically isolated chamber.

3. The system of claim 1, wherein the first transceiver is coupled to the tubular and the second transceiver is coupled to the casing string.

4. The system of claim 1, further comprising a second electrically isolated chamber between the tubular and the casing string for confining wireless signals from a third transceiver positioned in the second electrically isolated chamber to within the second electrically isolated chamber, the second electrically isolated chamber separate from the electrically isolated chamber.

5. The system of claim 4, wherein the third transceiver is operable to receive data from the second transceiver via a wire and wirelessly transmit the data to a fourth transceiver positioned in the second electrically isolated chamber, the wire extending between the electrically isolated chamber and the second electrically isolated chamber.

6. The system of claim 1, wherein the first transceiver comprises a sensor operable to generate data that is encoded in the wireless signal using frequency modulation.

7. The system of claim 1, wherein the electrically isolated chamber is operable to prevent external wireless communications from entering the electrically isolated chamber.

8. A system comprising:

an electrically isolated chamber that is between a tubular and a casing string in a wellbore, the electrically isolated chamber being configured to confine a transmission of a wireless signal to within the electrically isolated chamber; and a first transceiver that is positioned in the electrically isolated chamber for transmitting the wireless signal.

9. The system of claim 8, further comprising a second transceiver that is positionable in the electrically isolated chamber for receiving the wireless signal from the first transceiver, and wherein the first transceiver is coupled to the tubular and the second transceiver is coupled to the casing string.

10. The system of claim 9, wherein the tubular and the casing string both comprise a conductive material and define outer boundaries of the electrically isolated chamber.

11. The system of claim 9, further comprising a second electrically isolated chamber between the tubular and the casing string for confining wireless signals from a third transceiver positioned in the second electrically isolated chamber to within the second electrically isolated chamber, the second electrically isolated chamber separate from the electrically isolated chamber.

12. The system of claim 11, wherein the third transceiver is operable to receive data from the second transceiver via a wire and wirelessly transmit the data to a fourth transceiver positioned in the second electrically isolated chamber, the wire extending between the electrically isolated chamber and the second electrically isolated chamber.

13. The system of claim 8, wherein the first transceiver comprises a sensor operable to generate data that is encoded in the wireless signal using frequency modulation.

14. The system of claim 8, wherein the electrically isolated chamber is operable to prevent external wireless communications from entering the electrically isolated chamber.

15. A system for use in a wellbore, the system comprising:

a first transceiver that is positionable in a first electrically isolated chamber between a tubular and a casing string, the first electrically isolated chamber being operable to confine a first transmission of a first wireless signal from the first transceiver to within the first electrically isolated chamber; and a second transceiver that is positionable in a second electrically isolated chamber between the tubular and the casing string, the second electrically isolated chamber being operable to confine second transmission of second wireless signal from the second transceiver to within the second electrically isolated chamber, the second electrically isolated chamber separate from the first electrically isolated chamber.

16. The system of claim 15, wherein the tubular and the casing string comprise conductive materials and define outer boundaries of the first electrically isolated chamber and the second electrically isolated chamber.

17. The system of claim 15, wherein the first electrically isolated chamber or the second electrically isolated chamber comprises silicon oil or rubber for positioning the first transceiver or the second transceiver in a particular location within the first electrically isolated chamber or the second electrically isolated chamber, respectively.

18. The system of claim 15, wherein the first transceiver is coupled to the tubular and the second transceiver is coupled to the casing string.

19. The system of claim 15, wherein the first transceiver is operable to receive data via a wired interface from the second transceiver and wirelessly transmit the data to a third transceiver positioned in the first electrically isolated chamber.

20. The system of claim 19, wherein the second transceiver comprises a sensor operable to generate the data.

* * * * *